US009494112B2

(12) United States Patent
Janke et al.

(10) Patent No.: US 9,494,112 B2
(45) Date of Patent: Nov. 15, 2016

(54) EXHAUST GAS HEAT EXCHANGER AND METHOD

(71) Applicant: Modine Manufacturing Company, Racine, WI (US)

(72) Inventors: David Janke, Racine, WI (US); Viswanath Setty, Racine, WI (US); Jonathan Wattelet, Gurnee, IL (US); Thomas Grotophorst, Muskego, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 14/890,014

(22) PCT Filed: May 9, 2014

(86) PCT No.: PCT/US2014/037446

§ 371 (c)(1),
(2) Date: Nov. 9, 2015

(87) PCT Pub. No.: WO2014/183001

PCT Pub. Date: Nov. 13, 2014

(65) Prior Publication Data

US 2016/0146162 A1 May 26, 2016

Related U.S. Application Data

(60) Provisional application No. 61/822,041, filed on May 10, 2013.

(51) Int. Cl.
*F02M 26/32* (2016.01)
*F28D 7/16* (2006.01)
(Continued)

(52) U.S. Cl.
CPC ..... *F02M 26/32* (2016.02); *F02M 26/24* (2016.02); *F02M 26/28* (2016.02); *F28D 7/0075* (2013.01);
(Continued)

(58) Field of Classification Search
CPC ..... F02M 26/05; F02M 26/24; F02M 26/28; F02M 26/32; F28D 7/16; F28D 7/0075; F28D 7/1623; F28D 7/1684; F28D 7/0091; F28D 21/0003; F28D 2021/008; F02B 29/04; F28F 2280/02; F28F 2265/10
USPC ..... 123/568.12; 165/157, 158
See application file for complete search history.

(56) References Cited

U.S. PATENT DOCUMENTS 6,755,158 B2 6/2004 Knecht et al.
7,165,537 B2 1/2007 Agee et al.
(Continued)

OTHER PUBLICATIONS

International Search Report and Written Opinion for Application No. PCT/US2014/037446 dated Nov. 13, 2014 (14 pages).

*Primary Examiner* — Hieu T Vo
*Assistant Examiner* — Arnold Castro
(74) *Attorney, Agent, or Firm* — Michael Best & Friedrich LLP

(57) ABSTRACT

A heat exchanger that transfers heat from an exhaust gas flow to a liquid coolant includes a first heat exchange section and a second heat exchange section located adjacent the first heat exchange section. The first heat exchange section is located within a first housing that at least partially encloses a first fluid volume. The second heat exchange section is located within a second housing that at least partially encloses a second fluid volume. A first plurality of heat exchange tubes traverses the first heat exchange section, and a second plurality of heat exchange tubes traverses the second heat exchange section. An exhaust gas flow path of the heat exchanger includes the first fluid volume and the interiors of the second plurality of heat exchange tubes. A coolant flow path of the heat exchanger includes the second fluid volume and the interiors of the first plurality of heat exchange tubes.

15 Claims, 5 Drawing Sheets

(51) Int. Cl.
*F28D 7/00* (2006.01)
*F28D 21/00* (2006.01)
*F02B 29/04* (2006.01)

(52) U.S. Cl.
CPC ..... *F28D 7/16* (2013.01); *F28D 7/1623* (2013.01); *F28D 7/1684* (2013.01); *F28D 21/0003* (2013.01); *F02B 29/04* (2013.01); *F02M 26/05* (2016.02); *F28D 7/0091* (2013.01); *F28D 2021/008* (2013.01); *F28F 2265/10* (2013.01); *F28F 2280/02* (2013.01)

(56) References Cited

U.S. PATENT DOCUMENTS 7,171,956 B2 2/2007 Gami et al.
7,380,544 B2 * 6/2008 Raduenz ..... F28D 9/0056 123/568.12
8,079,410 B2 12/2011 Kim
8,186,424 B2 5/2012 Kardos
8,316,925 B2 11/2012 Pimentel et al.
8,528,629 B2 * 9/2013 Kalbacher ..... F02B 29/0412 165/140
2006/0196485 A1 * 9/2006 Kimura ..... F02M 26/48 123/568.16
2007/0246207 A1 * 10/2007 Nakamura ..... F28D 7/1684 165/173
2008/0264609 A1 * 10/2008 Lutz ..... F28D 7/0091 165/104.19
2009/0255251 A1 * 10/2009 Paffrath ..... F02D 9/04 60/602
2010/0108041 A1 * 5/2010 Gruner ..... F02M 26/73 123/568.12
2011/0247318 A1 * 10/2011 Kuroyanagi ..... F02M 25/0737 60/278
2012/0138279 A1 * 6/2012 Palanchon ..... F28D 7/1684 165/157
2014/0338643 A1 * 11/2014 Sundararaj ..... F02M 26/32 123/568.12

* cited by examiner

EXHAUST GAS HEAT EXCHANGER AND METHOD

CROSS-REFERENCE TO RELATED APPLICATIONS

This application claims priority to U.S. Provisional Patent Application No. 61/822,041, filed May 10, 2013, the entire contents of which are hereby incorporated by reference herein.

BACKGROUND

Emission concerns associated with the operation of internal combustion engines (e.g., diesel and other types of engines) have resulted in an increased emphasis on the use of exhaust gas heat exchangers. These heat exchangers are often used as part of an exhaust gas recirculation (EGR) system, in which a portion of an engine's exhaust is returned to the combustion chambers. Such a system displaces some of the oxygen that would ordinarily be inducted into the engine as part of the fresh combustion air charge with the inert gases of the recirculated exhaust gas. The presence of the inert exhaust gas typically serves to lower the combustion temperature, thereby reducing the rate of $NO_x$ formation.

In order to achieve the foregoing, it is desirable for the temperature of the recirculated exhaust to be lowered prior to the exhaust being delivered into the intake manifold of the engine. In the usual case, engine coolant is used to cool the exhaust gas within the exhaust gas heat exchanger (typically referred to as an "EGR cooler") in order to achieve the desired reduction in temperature. The use of engine coolant provides certain advantages in that appropriate structure for subsequently rejecting heat from the engine coolant to the ambient air is already available for use in most applications requiring an EGR system.

Due in large part to the elevated temperatures of the exhaust gas that they encounter, EGR coolers are known to be prone to thermal cycle failure. The desire for increased fuel economy continues to drive the engine operating temperatures upward, further exacerbating the problem. Above a certain temperature, the material properties of the metals used to produce the heat exchanger rapidly degrade, and the operational lifetime of the heat exchanger is substantially reduced. In order to combat this problem, it often becomes necessary either for the heat exchanger to be produced of more expensive alloys that can withstand these higher temperatures, or to increase the size and weight of the heat exchanger using the current materials, neither of which is desirable. Thus, there is still room for improvement.

SUMMARY

According to an embodiment of the invention, a heat exchanger to transfer heat from an exhaust gas flow to a liquid coolant includes a first heat exchange section and a second heat exchange section located adjacent to the first heat exchange section. The first heat exchange section is located within a first housing that at least partially encloses a first fluid volume. The second heat exchange section is located within a second housing that at least partially encloses a second fluid volume. A first plurality of heat exchange tubes traverses the first heat exchange section, and a second plurality of heat exchange tubes traverses the second heat exchange section. An exhaust gas flow path of the heat exchanger includes the first fluid volume and the interiors of the second plurality of heat exchange tubes. A coolant flow path of the heat exchanger includes the second fluid volume and the interiors of the first plurality of heat exchange tubes.

In some embodiments, the first fluid volume is arranged upstream of the interiors of the second of the second plurality of heat exchange tubes along the exhaust gas flow path. In some embodiments the second fluid volume and the interiors of the first plurality of heat exchange tubes are arranged fluidly in parallel along the coolant flow path. In some embodiments, a header plate separates the first fluid volume from the second fluid volume.

In some embodiments the second plurality of heat exchange tubes are flattened tubes defining a tube major dimension and a tube minor dimension smaller than the tube major dimension. In some embodiments the second plurality of heat exchange tubes are spaced apart from one another in the tube minor dimension and individual ones of the first plurality of heat exchange tubes are aligned with spaces between adjacent ones of the second plurality of heat exchange tubes.

In some embodiments, the heat exchanger includes a coolant inlet manifold in fluid communication with inlet ends of at least some of the first plurality of heat exchange tubes, and a coolant outlet manifold in fluid communication with outlet ends of at least some of the first plurality of heat exchange tubes. At least one of the coolant inlet manifold and the coolant outlet manifold are located within a wall section of the first housing. In some embodiments the coolant inlet manifold, the coolant outlet manifold, and the first plurality of heat exchange tubes are part of a replaceable cartridge.

According to another embodiment of the invention, a method of recirculating a flow of exhaust gas includes receiving the flow of exhaust gas, at an exhaust gas inlet temperature above a threshold temperature, into an exhaust inlet of a heat exchanger and directing the flow of exhaust gas through an inlet diffuser of the heat exchanger from the exhaust inlet to open ends of a plurality of exhaust tubes. A liquid coolant is directed through a plurality of coolant tubes arranged within the inlet diffuser in order to maintain the tube walls of the plurality of coolant tubes at a wall temperature substantially below the threshold temperature. The temperature of the flow of exhaust gas is reduced to an intermediate exhaust temperature below the threshold temperature prior to the exhaust gas reaching the open ends of the plurality of exhaust tubes by transferring heat through the tube walls to the liquid coolant flowing through the plurality of coolant tubes. The flow of exhaust gas is directed through the plurality of exhaust tubes, and a liquid coolant is directed over outside surfaces of the plurality of exhaust tubes. The temperature of the flow of exhaust gas is reduced from the intermediate exhaust temperature to a desired exhaust gas outlet temperature by transferring heat to the liquid coolant flowing over the outside surfaces of the plurality of exhaust tubes.

In some embodiments a flow of liquid coolant is separated into a first portion and a second portion. The first portion is directed to flow through the plurality of coolant tubes, and the second portion is directed to flow over the plurality of exhaust tubes.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
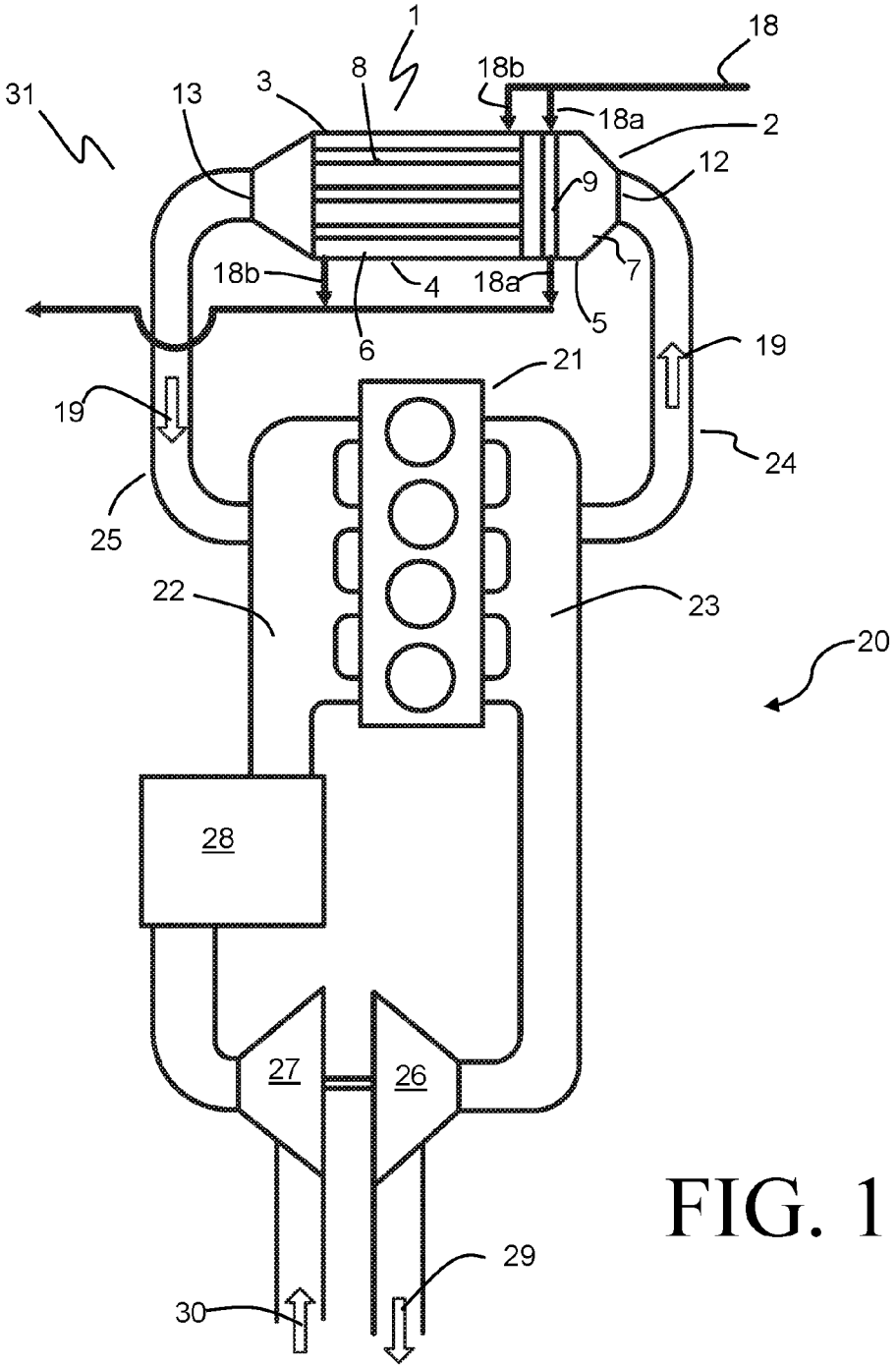
FIG. 1 is a schematic diagram of a power generation system employing an embodiment of the present invention.

One exemplary embodiment of a power generation system 20 employing the present invention is illustrated in FIG. 1. By way of example only, such a power generation system 20 can be used in vehicles, construction equipment, or stationary power generating devices. Power is generated within the system 20 by the use of an internal combustion engine 21, wherein a liquid or gaseous fuel (for example, gasoline, diesel, natural gas, propane, etc.) is combusted in order to produce mechanical work. Certain elements of the system 20, such as for example a fuel delivery sub-system, are well-known to those skilled in the art, and are not shown in order to focus more closely on those elements that are most relevant to the present invention.

In operation, a flow of air 30 is compressed and delivered to an intake manifold 22 of the engine 21. A supply of fuel (not shown) is delivered to the engine 21 and is combusted within the engine 21 using the air 30 to produce mechanical work. High temperature exhaust products resulting from the combustion are removed from the engine 21 by way of an exhaust manifold 23.

Otherwise wasted heat energy of the exhaust products can be recaptured and used to compress the incoming air 30 in a process commonly referred to as turbo-charging. A portion 29 of the hot exhaust products is directed through an expansion turbine 26, which is mechanically coupled to a compressor 27. Energy contained in the exhaust 29 is used to rotate the turbine 26, which in turn rotates the compressor 27. Rotation of the compressor 27 draws in and compresses the flow of air 30 that is to be directed to the engine 21. The compressed flow of air 30 can be directed through one or more heat exchangers 28 (typically referred to as a charge air cooler) in order to reduce the temperature of the air 30, thereby increasing the density of the air 30 and boosting the output of the engine 21.

A second portion 19 of the exhaust products is directed from the exhaust manifold 23 through an EGR circuit 31, and is subsequently directed back to the intake manifold 22. Located within the EGR circuit 31 is a heat exchanger 1 (the EGR cooler) wherein the temperature of the recirculated exhaust gas 19 is reduced. By supplying a flow of cooled, recirculated exhaust gas to the engine 21 along with the flow of air 30, undesirable emissions within the exhaust can be reduced to a level that complies with environmental regulations.

The recirculated exhaust gas 19 is directed through a conduit 24 from the exit manifold 23 to an exhaust inlet port 12 of the heat exchanger 1. After passing through the heat exchanger 1, the cooled recirculated exhaust gas 19 is removed from the heat exchanger 1 through an exhaust outlet 13, and is directed to the inlet manifold 22 by way of a conduit 25. Within the heat exchanger 1, heat is transferred from the recirculated exhaust gas 19 to a flow of coolant 18 directed through the heat exchanger 1.

Figure 2:
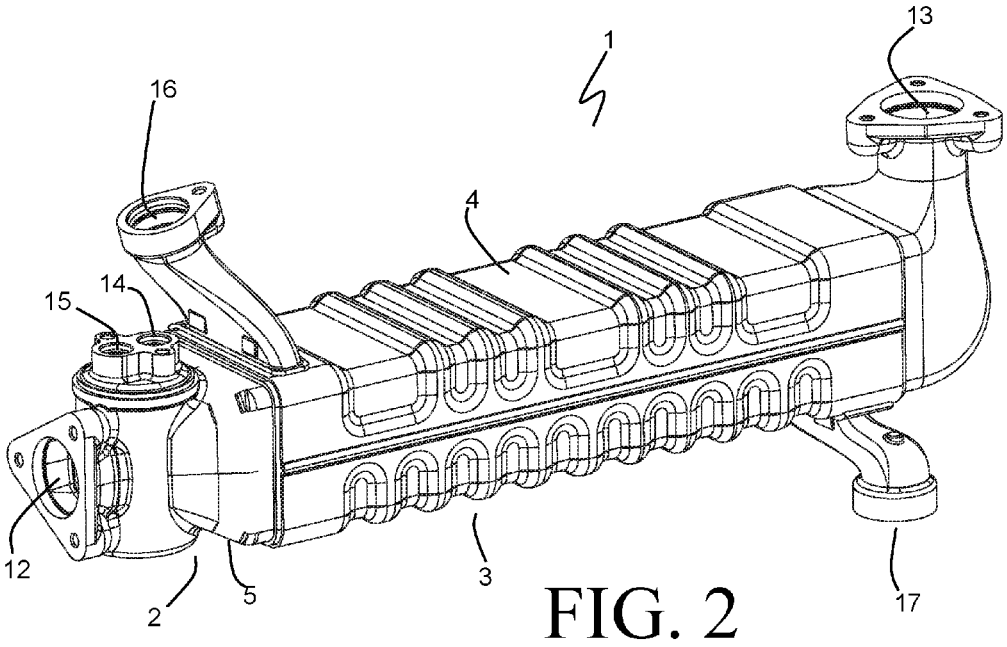
FIG. 2 is a perspective view of an exhaust gas heat exchanger according to an embodiment of the present invention.
Figure 3:
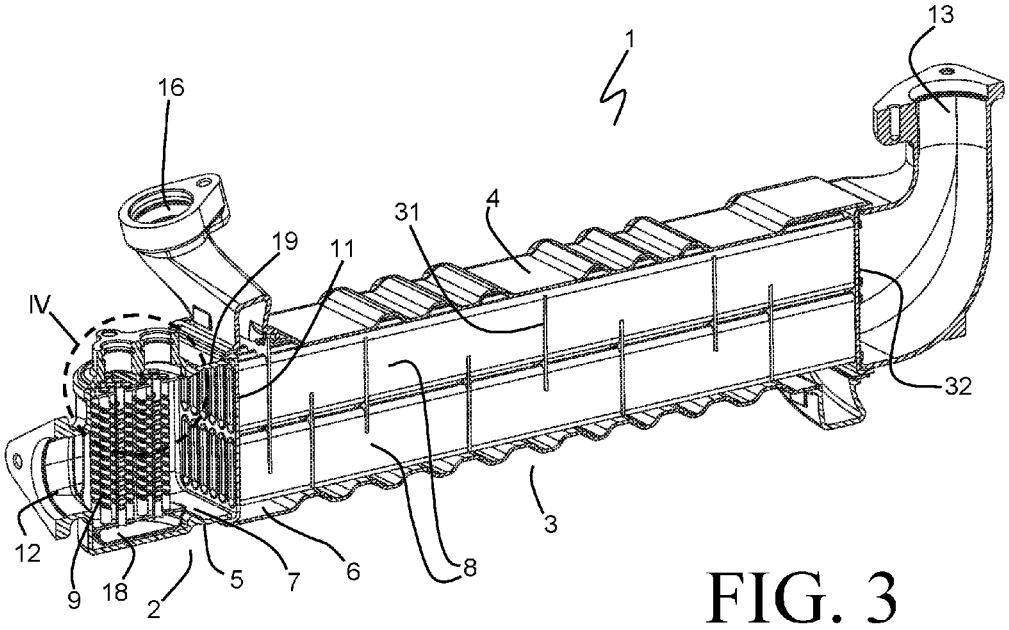
FIG. 3 is a cross-sectional perspective view of the exhaust gas heat exchanger of FIG. 2.
Figure 4:
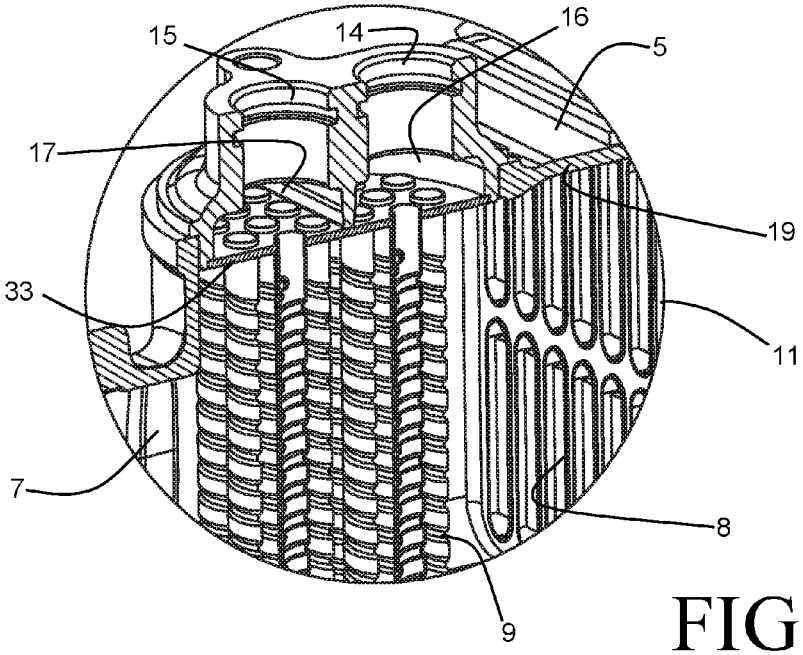
FIG. 4 is a detailed view of the portion of FIG. 3 indicated by the dashed circle IV.

As depicted diagrammatically in FIG. 1, and in more detailed fashion in FIGS. 2-4, the heat exchanger 1 includes a first heat exchange section 2 and a second heat exchange section 3, arranged sequentially along the flow path of the recirculated exhaust gas 19 between the inlet port 12 and the outlet port 13. The heat exchange section 2 is located within a housing 5, which at least partially encloses a fluid volume 7. The housing 5 can advantageously serve as the inlet diffuser for the heat exchanger 1. Tubes 9 extend through the fluid volume 7, and convey a portion 18*a* of the flow of coolant 18 through the heat exchange section 2 while maintaining isolation of the coolant 18*a* from the fluid volume 7 itself. The recirculated exhaust gas 19 passes through the fluid volume 7, and is cooled as it flows over the external surfaces of the tubes 9, which are maintained at a relatively low temperature by the coolant flowing therethrough.

The heat exchange section 3 is located within a housing 4, which at least partially encloses a second fluid volume 6. Tubes 8 extend through the fluid volume 6, and convey the exhaust gas 19 through the heat exchange section 3 while maintaining isolation of the exhaust gas 19 from the fluid volume 6 itself. A portion 18*b* of the flow of coolant 18 passes through the fluid volume 6, and flows over the outer surfaces of the tubes 8 to cool the exhaust gas 19 as it passes through the tubes 8.

The portions 18*a* and 18*b* of the coolant flow 18 can be arranged to be fluidly in parallel with one another, as indicated in FIG. 1. In some alternate embodiments, however, at least some of the coolant 18 can be part of both portions 18*a* and 18*b*As one non-limiting example, the portion 18*a* can be rejoined with the remainder of the coolant flow after passing through the heat exchange section 2, and can subsequently become a part of the portion 18*b* passing through the heat exchange section 3.

While the flow of coolant 18*b* in FIG. 1 is arranged to flow in a co-current flow orientation to the exhaust gas 19, in some alternative embodiments it may be preferable to flow the coolant 18*b* in a different orientation. For example, in some embodiments it may be preferable for the coolant 18*b* to flow in a counter-flow or a cross-flow orientation to the exhaust gas 19.

The above described EGR circuit 31 can be especially beneficial when the exhaust gas 19 that is to be recirculated back to the engine 21 exits the exhaust manifold at an excessively high temperature. EGR coolers are known to be prone to thermal cycle failures, due to the thin walls, multiple joints, and steep thermal gradients that are inherent in such heat exchangers. Quite often an EGR cooler will be designed to operate at a maximum, or threshold, exhaust gas inlet temperature. Certain material properties (for example, yield strength, creep resistance, etc.) of the steel alloys used in fabricating the EGR cooler will degrade rapidly above that threshold temperature, leading to increases in the strain values caused by the aggressive thermal cycles of the heat exchanger. As a result. when exhaust gas temperatures entering the EGR cooler exceed that threshold temperature, the lifetime of the EGR cooler may be substantially reduced. As a non-limiting example, an EGR cooler constructed primarily of stainless steel alloys having 16-18% nickel content will typically have a threshold temperature that is less than 650° C.

The portions of the EGR cooler that are most prone to failure when exposed to exhaust gases above the threshold temperature are the thin-walled heat exchange tubes through which the exhaust gas typically flows. In order to protect those tubes 8 in the heat exchange section 3, the exhaust gas is first cooled within the heat exchange section 2 by the coolant 18*a* flowing through the tubes 9. Flowing the coolant 18*a* through the tubes 9 maintains the walls of the tubes 9 at a temperature that is substantially below the threshold temperatures, even when the temperature of the exhaust gas being received into the diffuser 5 is at an inlet temperature that is above the threshold temperature. The transfer of heat from the exhaust gas to the coolant 18*a* reduces the temperature of the exhaust gas to an intermediate temperature that is below the threshold temperature prior to it reaching the tubes 8, thereby extending the life of the EGR cooler.

An exemplary embodiment of the heat exchanger 1 is shown in more detail in FIGS. 2-4, and will now be described. The previously described tubes 8 extending through the fluid volume 6, best seen in the sectional view of FIG. 3, are flattened tubes arranged in rows and extending between an inlet header 11 and an outlet header 32. Although not shown, extended surface area inserts can be provided within the tubes 8 to provide for increased heat transfer and structural support of the tubes 8. First ends of the tubes 8 are sealingly joined to the inlet header 11, and second ends of the tubes 8 are sealingly joined to the outlet header 32, to prevent leakage of the coolant 18*b* from the fluid volume 6 at the tube-header interfaces. Baffles 31 are provided at locations along the lengths of the tubes 8 in order to maintain the spacing between adjacent tubes 8, as well as to direct the flow of coolant 18*b* through the fluid volume 6. In some embodiments the tubes 8, header 11, header 32, and baffles 31 are all fabricated from a steel alloy and are joined together by way of a high-temperature brazing process.

The housing 4 is depicted as a two-piece casing that surrounds the bundle of tubes 8 and is joined to the headers 11 and 32 by welding in order to bound the fluid volume 6. In other embodiments the housing 4 can be a single piece casing into which the bundle of tubes 8 is received. The housing 4 can be constructed of steel alloy similar to the tubes and headers. Alternatively, since the housing 4 can be maintained at a substantially lower temperature by the coolant 18*b* flowing therethrough, it can be constructed of other material such as, for example, aluminum alloys. An inlet 16 to receive the flow of coolant 18*b* into the fluid volume 6, and an outlet 17 to remove the coolant 18*b* from the fluid volume 6, are provided in the housing 4.

The housing 5 functions as the inlet diffuser for the exhaust flow 19 passing through the heat exchanger 1, and is provided as a cast component joined to the inlet header 11 in order to define the fluid volume 7. An exhaust gas inlet 12 is provided in the housing 5 to allow for connection of the heat exchanger 1 to the conduit 24 of the EGR circuit 31.

Figure 5:
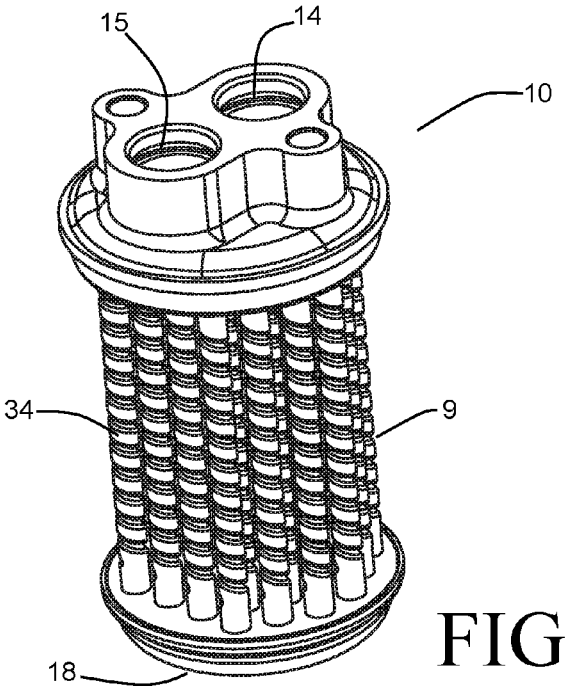
FIG. 5 is a perspective view of a component of the exhaust gas heat exchanger of FIG. 1.

The tubes 9 are provided as part of a heat exchanger cartridge 10 (shown in detail in FIGS. 4-5) inserted into the housing 5. The heat exchanger cartridge 10 includes coolant ports 14 and 15. In operation the flow 18*a* of coolant is received into one of the ports 14, 15, and is removed through the other of the ports 14, 15. In the illustrated embodiment, the ports 14 and 15 are located at a common end of the cartridge 10. As a result, the coolant 18*a* performs two passes through the heat exchange section 2, each pass including a subset of the tubes 9. A coolant manifold 16 is in direct fluid communication with the coolant port 14 and with open ends of one subset of the tubes 9, while a coolant manifold 17 is in direct fluid communication with the coolant port 15 and with open ends of another subset of the tubes 9. A common header 33 receives those open ends of the tubes 9, and seals off the manifolds 16 and 17 from the fluid volume 7 provided within the housing 5.

A return manifold 18 is provided at the end of the cartridge 10 opposite the ports 14 and 15, and receives the open ends of the tubes 9 at the ends opposite of those received into the header 33. During operation of the heat exchanger 1 within an EGR circuit 31, the flow 18*a* of coolant is received through one of the coolant ports 14 and 15 into one of the coolant manifolds 16 and 17, flows through those ones of the tubes 9 that have an open end connected to that one of the manifolds 16 and 17, enters into the return manifold 18, flows through the remainder of the tubes 9 to the other one of the coolant manifolds 16 and 17, and is removed from the heat exchanger 1 by way of the other one of the coolant ports 14 and 15.

The cartridge 10 can be constructed as a brazed or welded subassembly that is inserted into the housing 5. As shown in FIG. 4, the tubes 9 and the return manifold 18 are inserted through an aperture provided in a wall section 19 of the housing 5. The end of the cartridge 10 that includes the manifolds 16 and 17 is joined to the wall section 19 (for example, by welding) so that the manifolds 16 and 17 are located within the wall section 19. This can provide the added benefit of cooling the wall section 19 of the housing 5, thereby minimizing the structural loading that could otherwise be imposed upon the header 11 through the thermal expansion of the housing 5.

The cartridge 10 can be made to be replaceable in the event of a failure (such as for example, a coolant leak) occurring within the cartridge 10. As an example, the cartridge 10 can be readily removed and replaced by grinding away the welds that secure the cartridge 10 to the wall section 19, thereby avoiding the need to replace the entire heat exchanger 1.

By providing the ports 14 and 15 at common ends of the tubes 9, and providing a return manifold 18 at the opposing ends, the tubes 9 can be made to be thermally unconstrained within the housing 5. As a result, stresses within the tubes 9 that would otherwise result from differential thermal expansions between the housing 5 and the tubes 9 can be lessened, thereby increasing the durability of the heat exchanger 1.

The tubes 9 can advantageously be provided with twisted embossments 34 within the tube walls. These embossments 34 can provide beneficial turbulation of the coolant passing through the tubes 9, as wells as of the exhaust gas passing over the tubes 9, thereby improving the heat transfer performance within the heat exchange section 2. In addition, the embossments 34 provide the tubes 9 with structural compliance, thereby further reducing the likelihood of structural failures. In some embodiments the embossments 34 can take the form of a spiral channel formed into the wall of a tube 9 and extending along at least a portion of the length of the tube.

In some alternate embodiments of a heat exchanger 1, the structural compliance of the tubes may be sufficient to avoid the need for an unconstrained return manifold 18. In some of such alternate embodiments it may be desirable to provide the coolant manifolds 16 and 17 at opposing ends of the tubes 9, so that the flow of coolant 18*a* encounters only a single fluid pass through the heat exchange section 2. With such an alternative construction the manifolds 16 and 17 can be located within opposing wall sections of the housing 5, thereby further reducing the previously described structural loading of the header 11.

Figure 6:
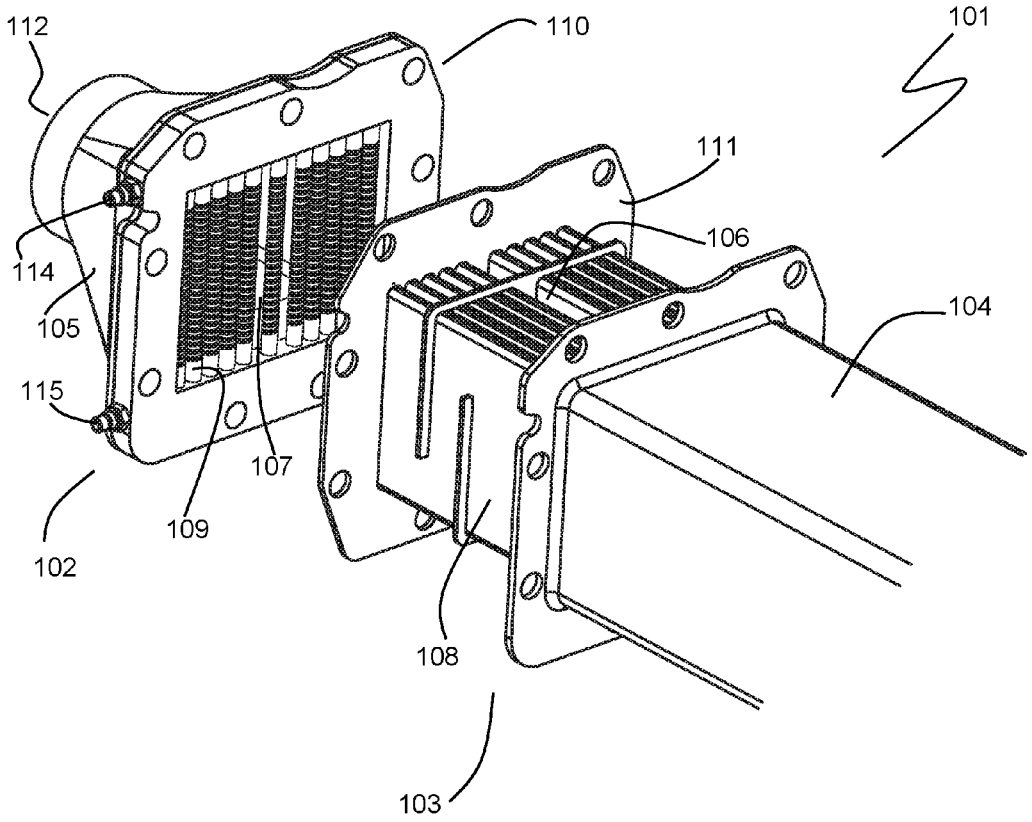
FIG. 6 is a partial exploded perspective view of an exhaust gas heat exchanger according to another embodiment of the present invention.
Figure 7:
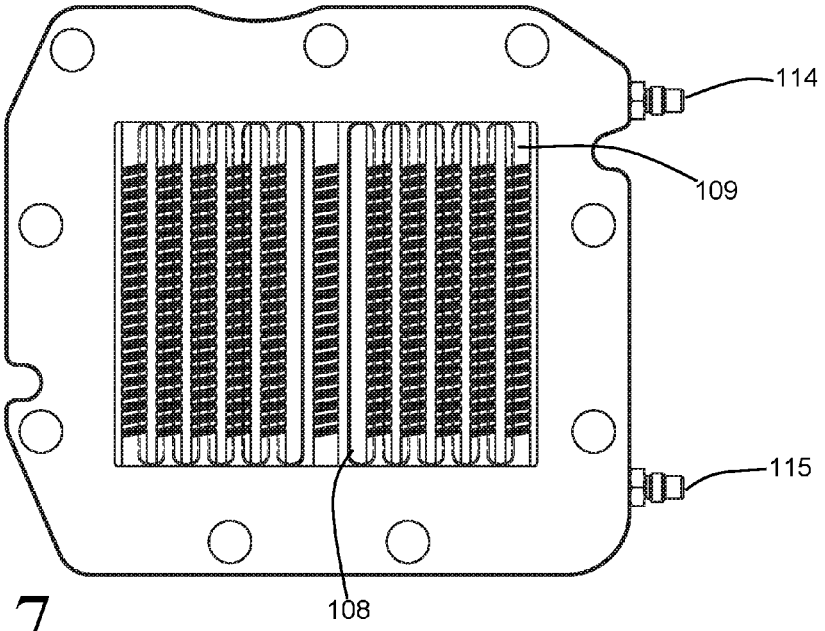
FIG. 7 is a side view of select portions of the exhaust gas heat exchanger of FIG. 6.

FIGS. 6 and 7 show one such alternate embodiment of a heat exchanger 101. The heat exchanger 101 includes a heat exchange section 103 arranged downstream of a heat exchange section 102 with respect to a flow of exhaust gas that enters the heat exchanger 101 through an exhaust gas inlet port 112. Within the heat exchange section 102, the exhaust gas passes through a fluid volume 107 that is partially enclosed by a housing 105. Within the heat exchange section 103, the exhaust gas passes through flat heat exchange tubes 108 arranged within a fluid volume 106 that is partially enclosed by a housing 104. A header 111 separates the fluid volume 106 from the fluid volume 107, and receives open ends of the tubes 108 to facilitate the transfer of the exhaust gas from the heat exchange section 102 to the heat exchange section 103.

Heat exchange tubes 109 traverse the heat exchange section 102, and allow for the exchange of heat between the exhaust gas flowing through the fluid volume 107 and a coolant flowing through the tubes 109. The coolant can be received into the heat exchanger 101 through the coolant port 114, and can be removed through the coolant port 115, or vice-versa. The heat exchange tubes 109, ports 114 and 115, and the manifolds joining the tubes 109 to the ports 114 and 115 can be provided as a pre-assembled and brazed cartridge 110. Such a cartridge 110 can be made to be readily replaceable in case of failure by, for example, assembling the heat exchanger 101 using bolts or similar mechanical fasteners extending through the pattern of aligned holes in the housing 104, header 111, and cartridge 110.

Figure 8:
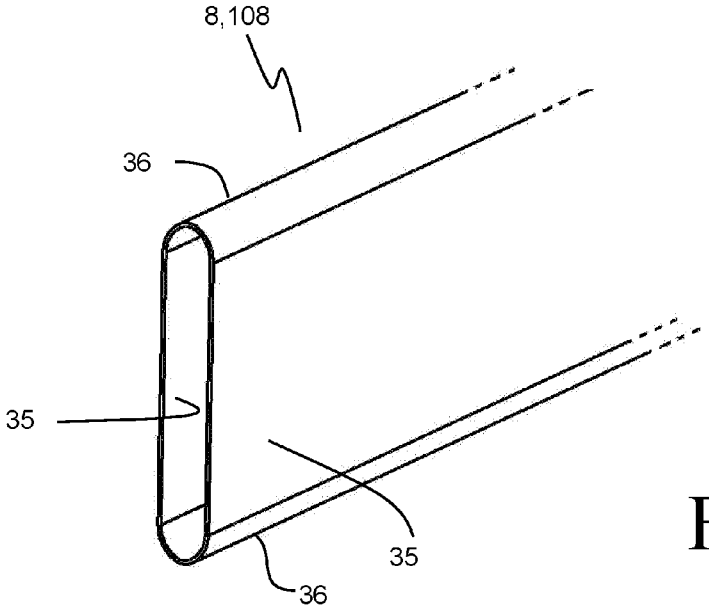
FIG. 8 is a partial perspective view of a heat exchanger tube for use in the exhaust gas heat exchangers of FIGS. 2 and 6.

As best seen in FIG. 8, the heat exchange tubes 8 and 108 are of a flattened tube design, with opposing broad and substantially flat side walls 35 spaced apart from one another. The opposing side walls 35 define a tube minor dimension between their outwardly facing surfaces. The side walls 35 are joined by a pair of arcuately shaped tube noses 36. The tube noses 36 define a tube major dimension between their outermost points, the tube major dimension being substantially greater than the tube minor dimension and in a direction that is perpendicular to the tube minor dimension. The tube noses 36 can alternatively take on other shapes, such as a more squared-off nose. Each of the tubes 8, 108 can be formed from a single sheet of material, or from two or more sheets of material.

In order to facilitate the flow of coolant around the heat exchange tubes 8 and 108, the tubes are preferably spaced apart from another in the tube minor dimension. As shown in FIG. 7, the heat exchange tubes 109 are arranged in a single row, and are spaced apart from one another such that they are aligned with the spaces between the tubes 108. As a result, the spaces between the tubes 109 are approximately in alignment with the open ends of the tubes 108, thereby minimizing the flow resistance imposed on the exhaust gas by the tubes 109.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

We claim:

1. A heat exchanger to transfer heat from an exhaust gas flow to a liquid coolant, comprising:

a first heat exchange section located within a first housing, the first housing at least partially enclosing a first fluid volume;

a second heat exchange section located within a second housing, the second housing at least partially enclosing a second fluid volume, the second heat exchange section located adjacent to the first heat exchange section;

a first plurality of heat exchange tubes traversing the first heat exchange section;

a second plurality of heat exchange tubes traversing the second heat exchange section;

an exhaust gas flow path comprising the first fluid volume and the interiors of the second plurality of heat exchange tubes; and a coolant flow path comprising the second fluid volume and the interiors of the first plurality of heat exchange tubes.

2. The heat exchanger of claim 1, wherein the first fluid volume is arranged upstream of the interiors of the second plurality of heat exchange tubes along the exhaust gas flow path.

3. The heat exchanger of claim 1, wherein the second fluid volume and the interiors of the first plurality of heat exchange tubes are arranged fluidly in parallel along the coolant flow path.

4. The heat exchanger of claim 1, further comprising a header plate separating the first fluid volume from the second fluid volume, first ends of the second plurality of heat exchange tubes being sealingly received within the header plate.

5. The heat exchanger of claim 1, wherein the second plurality of heat exchange tubes are flattened tubes defining a tube major dimension and a tube minor dimension smaller than the tube major dimension.

6. The heat exchanger of claim 5, wherein the second plurality of heat exchange tubes are spaced apart from one another in the tube minor dimension and individual ones of the first plurality of heat exchange tubes are aligned with spaces between adjacent ones of the second plurality of heat exchange tubes.

7. The heat exchanger of claim 1, wherein the first plurality of heat exchange tubes include a twisted embossment in the tube wall.

8. The heat exchanger of claim 1, further comprising:

a coolant inlet manifold in fluid communication with inlet ends of at least some of the first plurality of heat exchange tubes;

a coolant outlet manifold in fluid communication with outlet ends of at least some of the first plurality of heat exchange tubes; and a wall section of the first housing, wherein at least one of the coolant inlet manifold and the coolant outlet manifold are located within the wall section.

9. The heat exchanger of claim 8, wherein the first heat exchange section includes a replaceable cartridge comprising the coolant inlet manifold, the coolant outlet manifold, and the first plurality of heat exchange tubes.

10. The heat exchanger of claim 9, wherein the replaceable cartridge further comprises an intermediate coolant manifold arranged opposite the coolant inlet and outlet manifolds and fluidly joining outlet ends of some of the first plurality of heat exchange tubes and inlet ends of some of the first plurality of heat exchange tubes.

11. The heat exchanger of claim 9, wherein the replaceable cartridge is removable coupled to the first and second housings between the first and second housings.

12. The heat exchanger of claim 1, further comprising, an inlet diffuser for the exhaust gas flow path, and wherein the first plurality of heat exchange tubes transverse the inlet diffuser.

13. The heat exchanger of claim 1, further comprising an exhaust gas inlet port, wherein the first plurality of heat exchange tubes are adjacent the exhaust gas inlet port.

14. The heat exchanger of claim 13, further comprising a header plate, wherein first ends of the second plurality of heat exchange tubes are received within the header plate, and wherein the first plurality of heat exchange tubes are located between the exhaust gas inlet port and the header plate.

15. The heat exchanger of claim 1, wherein the first housing includes an inlet diffuser for the exhaust gas flow path.

* * * * *